United States Patent [19]

Leuchter

[11] 4,222,657

[45] Sep. 16, 1980

[54] CONTINUOUS FILM-DEVELOPING MACHINE

[75] Inventor: Jürgen Leuchter, Tutzing, Fed. Rep. of Germany

[73] Assignee: AGFA-Gevaert, A.G., Leverkusen, Fed. Rep. of Germany

[21] Appl. No.: 26,824

[22] Filed: Apr. 4, 1979

[30] Foreign Application Priority Data

Apr. 7, 1978 [DE] Fed. Rep. of Germany ..... 2815162

[51] Int. Cl.[3] ..... G03D 3/06

[52] U.S. Cl. ..... 354/324; 354/321; 134/56 R

[58] Field of Search ..... 354/297, 319, 320, 321, 354/322, 324, 86; 134/56 R, 64 P, 64 R, 122 P, 122 R; 226/10, 45

[56] References Cited

U.S. PATENT DOCUMENTS

| | | | |
|---|---|---|---|
| 2,778,734 | 1/1957 | Fairbank | 354/86 |
| 3,334,566 | 8/1967 | Friedel | 354/297 |
| 3,487,763 | 1/1970 | Pensgen | 134/56 R |
| 3,532,047 | 10/1970 | Pensgen | 134/56 R |
| 3,639,061 | 2/1972 | O'Brien et al. | 354/298 |
| 3,699,869 | 10/1972 | Jensen | 354/298 |
| 3,763,758 | 10/1973 | Manack et al. | 354/298 |
| 3,787,689 | 1/1974 | Fidelman | 354/298 |
| 4,021,832 | 5/1977 | Krehbiel et al. | 354/298 |
| 4,119,952 | 10/1978 | Takahashi et al. | 354/298 |

FOREIGN PATENT DOCUMENTS

| | | | |
|---|---|---|---|
| 1522856 | 10/1969 | Fed. Rep. of Germany . | |
| 2529007 | 1/1977 | Fed. Rep. of Germany | 354/324 |

*Primary Examiner*—L. T. Hix
*Assistant Examiner*—Alan Mathews
*Attorney, Agent, or Firm*—Michael J. Striker

[57] ABSTRACT

A continuous film developing machine adapted for processing photographic films of different formats and different patterns of film perforations, includes a series of treatment baths arranged consecutively in the path of movement of the processed film. Dosing devices with feeding valves adjust the amount of additional filling into the respective baths. A set of pneumatic sensors in the form of air nozzles is arranged opposite one side of the processed film strip, whereas a corresponding set of pressure air operated switches is arranged at the other side of the strip opposite respective nozzles. The switches detect the air jets passing through the perforations characteristic of each film format and actuate relay controlled switches which in turn put into operation a dosing device pertaining to the format of the processed film.

5 Claims, 2 Drawing Figures

CONTINUOUS FILM-DEVELOPING MACHINE

BACKGROUND OF THE INVENTION

This invention relates to a machine for continuously developing photographic films having different formats and different patterns of perforations. More particularly, this invention relates to a continuous film developing machine of the type having a series of treatment baths consecutively arranged in the path of movement of the film and cooperating with dosing devices for additionally filling regenerative agents into the bath, whereby each bath cooperates with one of a plurality of valves controlled by a control device and each being preadjusted for feeding a predetermined amount of processing liquid into the bath corresponding to the format of the film being processed. The valves, adjustable according to the format of the film, for feeding different doses of the processing liquid in the bath, are described in German patent application No. P 25 29 007.7.

The continuous film developing machine described in the above-mentioned patent application permits the processing of films having different formats. The additional admission of the regeneration liquid for the bath is effected by a dosing device, including a set of filling valves assigned to each bath and being adjusted respectively to different formats of the processed film. These valves are connected to an inlet conduit for the fresh bath liquid and communicate with the respective bath containers. The flow rate of each valve is individually adjustable to a predetermined film format. The adjustment can occur, for example, by series-connected switching or magnetic valves. These switching or magnetic valves are preferably hand controlled by the operator via control elements located at the control panel of the apparatus.

In the machine according to the aforementioned patent application, which operates substantially automatically, a disadvantage is to be seen in the fact that the dosing device has to be manually adjusted for each different format of the film. The operator can easily forget to readjust the dosing device when a change from one film format to another format takes place, especially when films having different formats are wound on a common spool, since film developing laboratories usually tend to avoid the use of an intermediate spacer strip between consecutive film strips. Instead, such laboratories prefer to wind different formats on a single spool until its full capacity is reached. Even if the operator takes all necessary precautions it is frequently difficult to switch over the developing machine at the correct points in time.

SUMMARY OF THE INVENTION

It is, therefore, a general object of the present invention to overcome the aforementioned disadvantages.

More particularly, it is an object of the invention to provide an improved continuous film-developing machine of the above-described type in which the additional dosing of the processing liquid is controlled automatically in response to the format of the film.

In keeping with these objects, and others which will become apparent hereafter, one feature of the invention resides, in a continuous film developing machine including a series of treatment baths and a dosing device including a set of adjustable valves assigned to each bath and controlled by a controlling device to feed an amount of liquid adjusted to a particular film format processed in the machine, in the provision of a set of pneumatic scanning elements arranged in the path of movement of the film and directed toward a corresponding set of pneumatically operable switches arranged at the opposite side of the film to detect the perforations characteristic of each film format and to actuate, via a switching device, the dosing valve adjusted for feeding the amount of processing liquid corresponding to the detected film format.

The scanning device in the machine of this invention provides for a simple, inexpensive and contactless detection of the processed film strips and the corresponding control of the after-dosing operation. In comparison with optical scanning elements which are susceptible to pollution, the pneumatic scanning device has the advantage that it cleans itself. In addition, a pneumatic-electrical (PE) converter which can be used to directly activate a switch so that any amplifying electronic circuits, which are necessary, e.g. in the case of a light barrier, can be dispensed with.

From German publication DE-OS No. 1,522,856 a pneumatic scanning device is known for detecting the format of film strips to control the additional dosing, wherein particularly the movement of different films on different tracks is monitored. This known device detects, however, only the width of the film strips. Such a method is unsuitable for the purposes of this invention inasmuch as, for example, the film formats "126" and "135" have the same film strip width but must be processed in different baths requiring different additional dosing.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
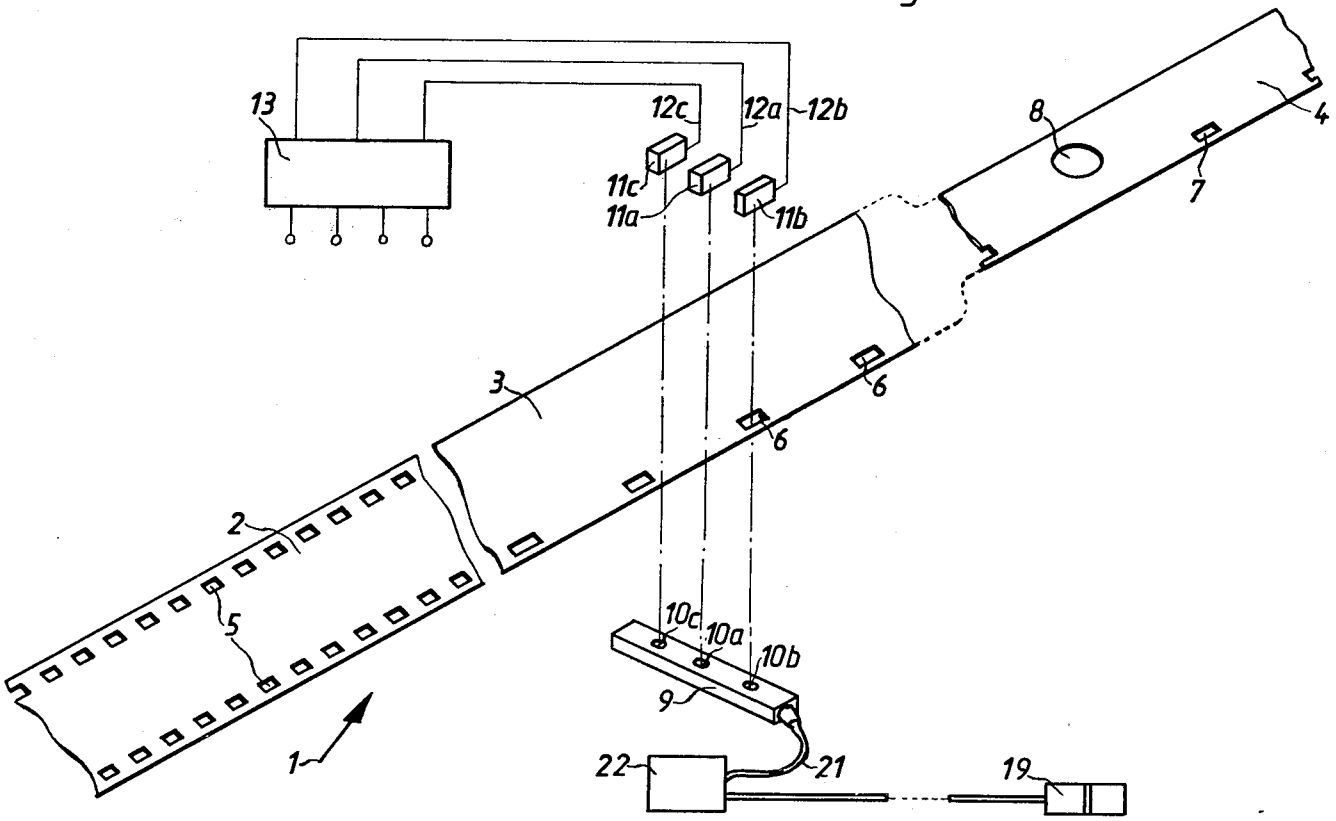
FIG. 1 is a schematic perspective view of the pneumatic scanning device of this invention.

In FIG. 1 reference numeral 1 indicates a photographic film strip in which different sections 2, 3 and 4 have different formats such as type 135-film, type 126-film and type 110-film. The 135-film 2 is provided at both sides thereof with perforations 5. The 126-film 3 has perforations 6 at one side only each being assigned to one image. The 110-film 4 has in addition to lateral perforations 7, a relatively large central hole 8 at each end of the film strip and this central hole 8 is characteristic for this film format.

The film strip 1 is guided over a transverse bar or pipe 9 in which a set of air nozzles 10 is formed. The pipe 9 is essentially constructed as a pressure chamber and communicates via conduit 21 with an air pressure source 22. The nozzles 10 are consecutively arranged in the pipe 9 so that the intermediate nozzle 10*a* coincides with the central hole 8 of the 110-film 4. Both lateral nozzles 10*b* and 10*c* are spaced apart from the intermediate nozzle 10*a* at such a distance that they are out of the range of the 110-film 4. The two lateral nozzles 10*b* and 10*c* however, are arranged opposite the perforations 5 on both sides of the 135-film strip 2. The equally wide 126-film strip 3 has its perforations 6 arranged opposite one of the lateral nozzles 10*b* or 10*c* depending on the position in which the strip 3 is stuck to the remaining films.

Pneumatic-electrical converters 11*a*, 11*b* and 11*c* face respective nozzles 10 from the other side of the film strip 1 and are connected via conductors 12*a*, 12*b* and 12*c* to a switch box 13. In this example, the converters 11 are airwave pressure operated switches.

Figure 2:
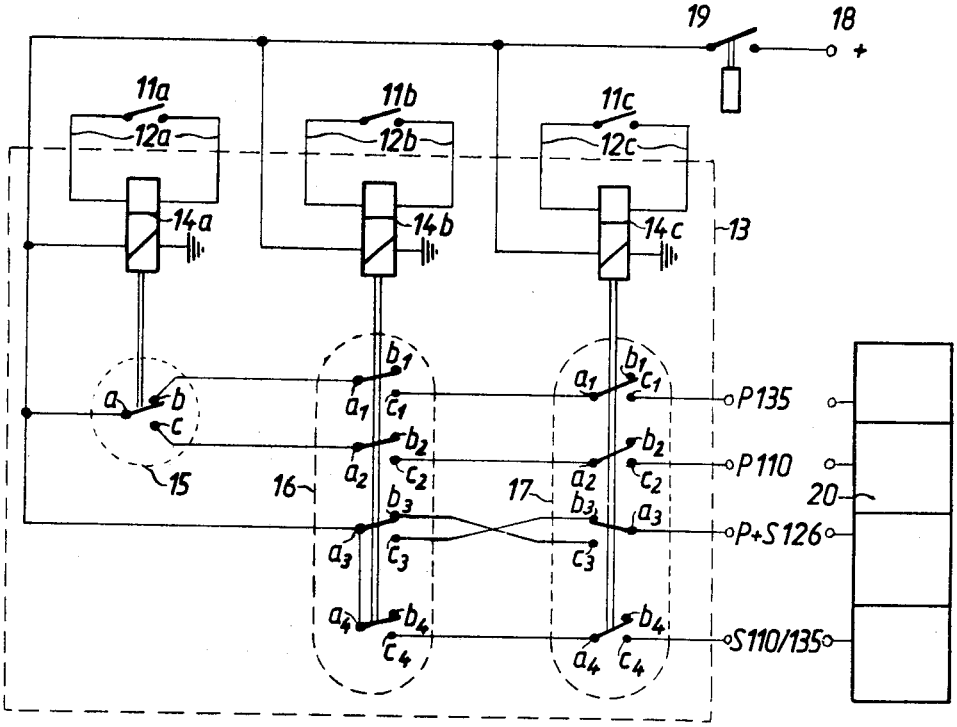
FIG. 2 is a circuit diagram of the control device of this invention.

The switch box 13 is illustrated in detail in FIG. 2. The pressure switch 11*a* has its conductor 12*a* connected in the circuit of a timing relay 14*a* which in turn is coupled to the contact arm of a two-position switch 15. The pressure switch 11*b* activates via its conductor 12*b* the energization circuit of timing relay 14*b* which is mechanically coupled to the switching contact of a two-position multiple switch 16. Similarly, the third pressure actuated switch 11*c* is connected to the energization circuit of timing relay 14*c* which is mechanically coupled to switching contact of a multiple switch 17. The energizing circuits of the relays 14*a*–14*c* with the series connected switches 11*a*–11*c* are connected to a power source 18 via a main switch 19. The switch 19 may also be, if desired, a pneumatic switch situated at the inlet part of the developing machine and being closed when a film strip is inserted in the machine.

The operation of timing relays 14*a*–14*c* is as follows:

When one of the pressure switches 11*a*–11*c* is activated, the corresponding relay becomes energized by the current from power source 18 and switches over the movable contact of the assigned multiple switch. When a pressure switch becomes open, the assigned timing relay is deenergized only upon the expiration of an adjustable delay time. The time delay is adjusted substantially according to the speed of the film feeding which may be approximately 13 meters per minute or in the case of increased processing speeds also 18 meters and more per minute. In the case of processing speed of 13 meters per minute, for example, the delay of the timing relays 14*b* and 14*c* is about 3 seconds, whereas relay 14*b* responding to the detection of the central hole 8 of the 110-film 4, remains energized for about 8 seconds since the central hole takes place only at the end of the film strip. The setting of the time delay of about 3 seconds is sufficient for bridging the intervals between the widely spaced perforations of the 126-film 3.

The connection of the multiple switches 15, 16 and 17 is as follows:

The input contact 15*a* is connected via main switch 19 to power source 18 and the output contacts 15*b* and 15*c* of switch 15 are connected respectively to input contacts 16*a*1 and 16*a*2 of the multiple switch 16. The remaining two input contacts 16*a*3 and 16*a*4 of the switch 16 are also connected to the power source 18. The output contact 16*c*1 is connected to the input contact 17*a*1 of the multiple switch 17. The output contact 16*c*2 is connected to the input contact 17*a*2, the output contact 16*b*3 is connected to the output contact 17*c*3, the output contact 16*c*3 is connected to the output contact 17*b*3 and the output contact 16*c*4 is connected to the input contact 17*a*4. The remaining output contacts 16*b*1, 16*b*2 and 16*b*4 as well as the output contacts 17*b*1, 17*b*2 and 17*b*4 are free. The output contacts 17*c*1, 17*c*2 and 17*c*4 are connected respectively to terminals P135, P110 and S110/135 and the input contact 17*a*3 is connected to the terminal P+S126. The symbols of the terminals P135, P110, P+S126 and S110/135 indicate the primary or secondary baths for different film formats such as 110, 126 and 135 films and are connected to corresponding terminals of a control device 20 which is constituted essentially of the corresponding number of needle valves forming a dosing device according to the one disclosed in the aforementioned German patent application No. P 25 29 007.7.

The operation of the pneumatic scanning device as illustrated in FIGS. 1 and 2 is as follows:

Upon the actuation of the developing machine, the pressure air generator 22 is also actuated so that pressure air is supplied into pipe 9 and therefrom through the nozzles 10 against the pressure wave actuated switches 11*a*–11*c*; in addition, by a separate conduit the pneumatic switch 19 is supplied with the pressure air and as long as no film takes place in the developing machine, the switch 19 is open so that time relays are without current even if pressure switches 15–17 are actuated. As soon as a film strip or an intermediate auxiliary strip is fed past the switch 19, the latter is closed and supply current circuit from the source 18 is switched on.

When a film strip passes between the nozzles 10*a*–10*c* in the pipe 9 and the pressure switches 11*a*–11*c*, the latter switches are selectively actuated or deactuated in response to the format of the film strip. When a 110-film 4 is situated above the pipe 9, the lateral nozzles 10*b* and 10*c* are not covered by the narrow film strip of the format 110 and the lateral pressure switches 11*b* and 11*c* become activated by the pressure air from the lateral nozzles. The intermediate pressure switch 11*a* is activated by the pressure air only when the central hole 8 of the film strip 4 passes over the intermediate nozzle 10*a*. Upon closing of switches 11*a*–11*c* all relays 4*a*–4*c* become energized and remain in this energized state with the preadjusted time delay. During the energization of the relays 14, the multiple switches 15–17 are switched over from their open position as illustrated in FIG. 2 to their closed position in which the contacts a and c are closed by the movable contact. In this closed position, the power source 18 is connected via contacts 15*a*, 15*c*, 16*a*2, 16*c*2, 17*a*2, 17*c*2 to the terminal P110 and in addition, via contacts 16*a*4, 16*c*4, 17*a*4, 17*c*4 to terminal S110/135, and the control device 20 is activated to supply the primary bath as well as the secondary bath with doses appropriate for the 110-film format. When a 126-film 3 passes over the pipe 9, either the nozzle 10*b* or the nozzle 10*c* is intermittently uncovered by the perforations 6, whereas the remaining nozzles remain permanently covered. As a consequence, the current from the power source 18 flows via contacts 16*a*3, 16*b*3, 17*c*3 and 17*a*3 to terminal P+S126 or via the contacts 16*a*3, 16*c*3, 17*n*3 and 17*a*3 to the same terminal P+S126.

If a 135-film 2 is fed past the scanning device of this invention, the intermediate nozzle 10*a* is covered, whereas both lateral nozzles 10*c* and 10*b* are intermittently uncovered through the perforations 5 provided on both sides of the film strip 2 and consequently both switches 11*b* and 11*c* are switched on and the multiple switches 16*b* and 16*c* are switched over. As a result, the terminal P135 is connected to the power source 18 via contacts 15*a*, 15*b*, 16*a*1, 16*c*1, 17*a*1 and 17*c*1, and terminal S110/135 is connected to the power source via the contacts 16*a*4, 16*c*4, 17*a*4 and 17*c*4.

As soon as the end of the processed film strip is moved away from the range of the pneumatic switch 19, the supply of electric current from the power source 18 is interrupted and the additional dosing is discontinued.

The advantage of this invention is to be seen also in the fact that the switching box 13 is exchangeable so that the control device 20 can easily be matched to other processing methods employing an increased number of baths. Moreover, a non-illustrated optical indicator at the front panel of the machine can be activated in response to the activation of particular P-terminals so that it is always visible what format is being processed.

It will be understood that each of the elements described above, or two or more together, may also find a useful application in other types of constructions differing from the types described above.

While the invention has been illustrated and described as embodied in a developing machine, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A machine for continuous developing of films having different formats and different patterns of film perforations characteristic of each film format, comprising a series of treatment baths consecutively arranged in the path of movement of the film; dosing devices cooperating with said baths and each including a plurality of valves controlled by a control device to adjust the flow rate of the processing liquid according to the format of the processed film; a set of pneumatic scanning elements arranged transversely in said path of movement at one side of the processed film to direct air jets against the perforations characteristic of each film format; a corresponding set of pneumatically activated switches arranged opposite said scanning elements on the other side of the processed film to detect said characteristic perforations; and an electric switching device being controlled by said pneumatic switches to activate said valves in response to the actuation of respective pneumatic switches.

2. The machine as defined in claim 1, wherein said switches are pneumatic-electrical convertors for converting the pressure detected from a juxtaposed scanning element into an electrical signal.

3. The machine as defined in claim 2, wherein said switching device includes a plurality of timing relays activated by said pneumatic-electric convertors and a plurality of multiple switches switched over in response to the activation of said timing relays.

4. The machine as defined in claim 3, wherein said multiple switches are two-position switches having a plurality of contacts interconnected for energizing said dosing devices.

5. The machine as defined in claim 1, adapted for processing a continuous film strip assembled of series connected film portions having different formats and different patterns of film perforations, said scanning elements being air nozzles spaced apart from one another according to the location of different perforations of respective strip portions, and said timing relays being adjusted to delay the return of said multiple switches into their open position for a time sufficient for compensating the interruptions of the scanning air jets between the different perforations.

* * * * *